US006168155B1

(12) United States Patent
Kuhlman et al.

(10) Patent No.: US 6,168,155 B1
(45) Date of Patent: Jan. 2, 2001

(54) RANDOM SELECTION GAME DEVICE

(75) Inventors: Kurt Kuhlman, Lakewood; Greg Nuebel, Bailey; Davey Palmer, Highlands Ranch; Jim Schreiber, Littleton, all of CO (US)

(73) Assignee: Stuart Entertainment, Council Bluffs, IA (US)

( * ) Notice: Under 35 U.S.C. 154(b), the term of this patent shall be extended for 0 days.

(21) Appl. No.: 09/237,118

(22) Filed: Jan. 26, 1999

(51) Int. Cl.[7] ..... A63F 3/06
(52) U.S. Cl. ..... 273/144 A; 273/138.2; 273/144 R
(58) Field of Search ..... 273/144 R, 144 A, 273/144 B, 138.1, 138.2

(56) References Cited

U.S. PATENT DOCUMENTS 3,044,780 * 7/1962 Silverman ..... 273/144 A
5,121,920 * 6/1992 Laezzo et al. ..... 273/144 A

OTHER PUBLICATIONS

"Corona Integra", 1996–1997 Bazaar & Novelty catalog, pp. 48–49, Jan. 1996.*

* cited by examiner

*Primary Examiner*—Benjamin H. Layno
(74) *Attorney, Agent, or Firm*—Morrison & Foerster LLP

(57) ABSTRACT

This invention is to a random selection game device. In particular, the invention is a device for randomly selecting game balls, and is particularly useful in bingo or lottery-type games. In one embodiment, the invention includes an air mix housing which comprises an outer vertical walled section and an inner vertical walled section, the inner vertical walled section being permeable to air, a top portion and a bottom portion abutting the inner and outer vertical walled sections, the bottom portion of the air mix housing having an air discharge section and an air intake section; and an air mover having an air discharge end and an air suction end, the air discharge end being connected to the air intake section of the of the bottom portion of the air mix housing and the air suction end being in fluid connection with the air discharge section of the bottom portion of the air mix housing.

16 Claims, 6 Drawing Sheets

RANDOM SELECTION GAME DEVICE

FIELD OF THE INVENTION

This invention relates to a random selection game device. In particular, the invention is a device for randomly selecting game balls, and is particularly useful in bingo or lottery-type games.

Devices for randomly selecting game balls have been in existence for many years. These devices typically house game balls in a glass or Plexiglas-type chamber. The balls are usually mixed within the chamber using an air blower located underneath the ball chamber. Various types of mechanical means have been used to randomly capture the game balls once the air blower has been engaged.

To obtain quick and efficient mixing of the game balls, a blower having sufficient air discharge velocity is required. Not only is complete mixing necessary to achieve a pure random distribution in the selection of the game balls, but high velocity mixing is more aesthetically pleasing to observe by the game player as it purveys high energy action. Known systems are somewhat problematic in this regard, however, in that the greater the force of the air displaced through the ball a chamber, the greater the force of the balls being displaced within the ball chamber. This typically results in a relatively loud noise, since the balls are being displaced off of the rigid walls of the ball chamber. The greater the number of balls, the louder the total impact against the rigid walls.

In a game such as bingo, game balls are removed from the ball chamber until a winner is declared. As the balls are removed, the noise within the chamber can decrease. Although this lessens the auditory impact, the visual impact is affected in that fewer balls can appear to give the impression of a less lively game.

The balls of typical random game selection devices are of a plastic material, with all markings typically printed on the inside portion of the plastic. They are typically hollow and pressurized with a light molecular weight gas, such as nitrogen. This allows the balls to bounce around the ball chamber much more quickly and give the appearance of providing a livelier game. The plastic materials, however, have a tendency to accumulate a static charge and this accumulation can have an adverse affect on the entire system.

Many random game selection devices are generally limited in ability to recycle air circulated within the ball chamber. These types of systems are, therefore, required to intake a large amount of air from the external surroundings, and force that external air through the ball chamber. The result typically adds to the noise level.

It is an object of this invention to overcome the problems present in many of the known random game selection devices. In particular, the random game selection device of this invention is an improved device that is lower in noise, provides increased visibility features, maintains clean air within the ball chamber and limits the amount of static charge accumulation.

SUMMARY OF THE INVENTION

This invention overcomes problems inherent in the prior art by providing a random selection game device which comprises an air mix housing comprising an outer vertical walled section and an inner vertical walled section, the inner vertical walled section being permeable to air, a top portion and a bottom portion abutting the inner and outer vertical walled sections, the bottom portion of the air mix housing having an air discharge section and an air intake section; and an air mover having an air discharge end and an air suction end, the air discharge end being connected to the air intake section of the of the bottom portion of the air mix housing and the air suction end being in fluid connection with the air discharge section of the bottom portion of the air mix housing.

In a preferred embodiment, the random selection game device further comprises an air suction chamber enclosing the air mover, with the air suction chamber having an opening for supplying air to the air suction end of the air mover. Further provided can be an opening to control the amount of air that is supplied to the air suction end of the air mover. An air filter can also be provided between the air intake control device and the air suction chamber opening.

The random selection game device can also include a flexible, static discharge bar electrically grounded to the bottom portion of the air mix housing, and covering the air intake section of the bottom portion of the air mix housing. In addition, the outer vertical walled section comprises a curved vertical back wall connected to a curved vertical front wall, the curved vertical back wall and the curved vertical front wall each having a radial center offset from one another, the vertical back wall further comprising an image reflecting surface internal to the armix housing.

In another embodiment is provided a random selection game device which comprises an air mix housing comprising a curved vertical back wall connected to a curved vertical front wall, the curved vertical back wall and the curved vertical front wall each having a radial center offset from one another, the vertical back wall further comprising an image reflecting surface internal to the air mix housing, and a top portion and a bottom portion abutting the curved vertical back wall and the curved vertical front wall, the bottom portion of the air mix housing having an air discharge section and an air intake section; and an air mover having an air discharge end and an air suction end, the air discharge end being connected to the air intake section of the of the bottom portion of the air mix housing and the air suction end being in fluid connection with the air discharge section of the bottom portion of the air mix housing. This embodiment can include an inner vertical wall section permeable to air, internal to the air mix housing, and abutting the top and bottom portions.

The additional embodiment can also include an air suction chamber enclosing the air mover, with the air suction chamber having an opening for supplying air to the air suction end of the air mover. An air intake control device in fluid connection with the air suction chamber opening to control the amount of air that is supplied to the air suction end of the air mover can be further included. A flexible, static discharge bar electrically grounded to the bottom portion of the air mix housing, and covering the air intake section of the bottom portion of the air mix housing can also be included.

In yet another embodiment, there is provided a random selection game device which comprises an air mix housing comprising vertical walls, and a top portion and a bottom portion abutting the vertical walls, the bottom portion of the air mix housing having an air discharge section and an air intake section; an air mover having an air discharge end and an air suction end, the air discharge end being connected to the air intake section of the of the bottom portion of the air mix housing and the air suction end being in fluid connection with the air discharge section of the bottom portion of the air mix housing; and a flexible, static discharge bar electrically grounded to the bottom portion of the air mix housing, and covering the air intake section of the bottom portion of the air mix housing. The embodiment can include an inner vertical walled section permeable to air, internal to the air mix housing, and abutting the top and bottom portions. An air suction chamber enclosing the air mover, with the air suction chamber having an opening for supplying air to the air suction end of the air mover is preferably included. The amount of air that is supplied to the air suction end of the air mover can be controlled by including an air intake control device in fluid connection with the air suction chamber opening. In a further preferred embodiment, the vertical walls can comprise a curved vertical back wall section connected to a curved vertical front wall section, the curved vertical back wall section and the curved vertical front wall section each having a radial center offset from one another, and the vertical back wall section having an image reflecting surface internal to the air mix housing.

DESCRIPTION OF THE PREFERRED EMBODIMENTS

Figure 1:
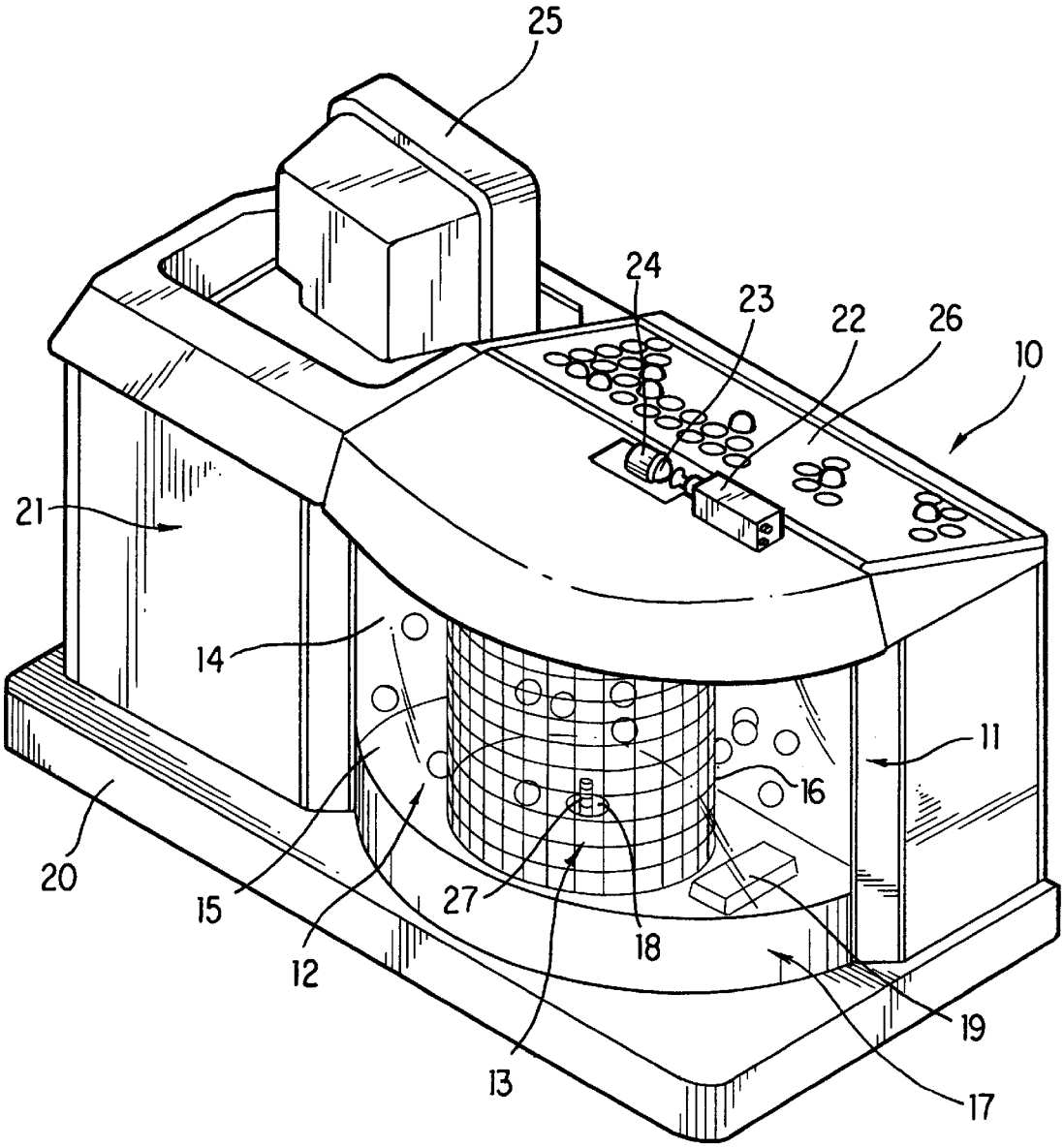
FIG. 1 is a top perspective view of the front portion of the random game selection device of this invention.

The preferred embodiments of the random selection game device of this invention are described with regard to FIGS. 1–6, with the overall random selection game device being generally designated by the reference number 10. One of the preferred features of the random selection game device 10 is the air mix housing 11. The air mix housing 11 comprises an outer vertical walled section 12 and an inner vertical walled section 13. The outer vertical walled section can be formed by any unitary barrier that is impermeable to air. Preferably, the outer walled section 12 is formed by a solid, translucent material so that the game player can view balls held within the air mix housing during play. Preferably, the material is made of a Plexiglas-type component, although any substitute material can be used. Any shape can be used that is suitable for viewing, such as a circular or oval shape. However, it is preferred that the outer vertical wall section 12 comprise a curved vertical back wall 14 connected to a curved vertical front wall 15. The vertical back wall 14 preferably comprises an image reflecting surface internal to the air mix housing 11. This reflecting surface enhances the visibility of game balls bouncing within the housing during play, giving the impression of a livelier game. In a more preferred embodiment, the curved vertical back wall 14 and the curved vertical front wall 15 will each have a radial center offset from one another. The offset centers result in a slight distortion of the reflection of the game balls in action, which further contribute to the livelier appearance of the game balls during play.

The inner vertical wall section 13 of the air mix housing 11 lies within the outer vertical wall section 12, and is defined by an inner vertical wall 16 that is permeable to air. The inner vertical wall 16 can be made of a variety of materials, as long as the material is translucent such that the game player can see the balls in action during game play. Preferably, the air permeable vertical wall 16 is made of a sound absorbing material. More preferably, the inner vertical wall 16 is made of a net-like material that is sufficient to contain the game balls, yet appears almost entirely translucent. For example, a clear polymer-type netting can be used.

Below the air mix housing 11 is an air suction chamber 17. Within the air suction chamber 17 is located an air mover device for displacing the game balls during play. Between the air suction chamber 17 and the air mix housing 11 is located an air discharge opening 18 through which air from the air mover can be displaced.

It is preferable that a recycle air vent 19 also be included between the air mix housing 11 and the air suction chamber 17. This will allow recirculation of air flowing through the air mix housing. Although FIG. 1 shows the recycle air vent 19 located in the outer vertical walled section 12, this vent can also be located within the inner vertical walled section 13.

The entire random selection game device is situated atop base support 20. The base support 20 can also be configured to support a separate computer control section 21, if desired. The computer control section 21 provides a computer system which allows for multi-gaming, and can provide enhanced video display. For example, in a preferred embodiment, the random selection game device 10 includes a video camera 22. A game ball 23 is collected in a ball catch 24 from the air mix housing 11, and the game ball 23 and ball catch 24 are aligned such that the camera 22 captures the image of the ball. Any marking on the game ball can be relayed to the computer control section, and ultimately depicted on a video monitor 25. Using appropriate hardware and software, additional video displays can be arranged throughout the gaming area. Once an image has been captured by camera 22, the game caller can move the game ball 23 collected in the game collector 24 into a ball collection tray 26. This type of arrangement is particularly handy for bingo games in which a number of balls must be collected before there is a winner.

The air mix housing 11 preferably includes a static discharge bar 27. The bar is located within a central portion of the air mix housing 11 so that it is more likely to contact all of the game balls during play. The static discharge bar 27 is preferably non-rigid or flexible to reduce possible damage to the game balls and to reduce noise. In a more preferred embodiment, the static discharge bar 27 is a metal spring which is situated directly over air discharge opening 18 between the air suction chamber 17 and the air mix housing 11, and is preferably electrically grounded to the bottom portion of the air mix housing.

Figure 2:
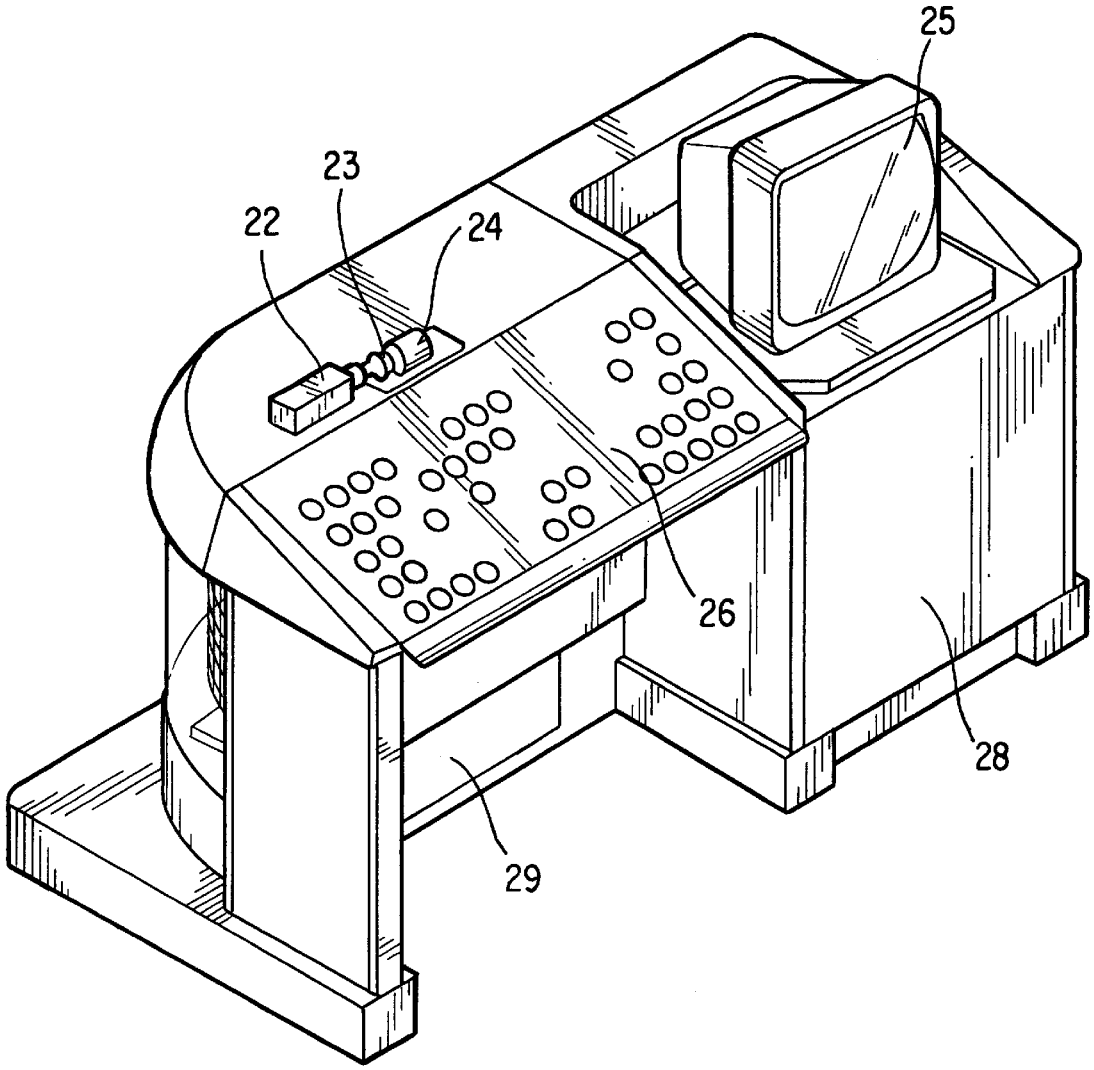
FIG. 2 is a top perspective view of the back portion of the random game selection device of this invention.

FIG. 2 shows the back of the random selection game device 10 where the game caller controls the play of the game. Once the game ball 23 is collected in the ball catch 24, the image of the ball is recorded by the camera 22. The recorded image can be checked by the game caller on the video monitor 25, then the game caller can remove the game ball 23 from the ball catch 24 for the next play. The game ball 23 can be placed in the ball collection tray 26 and stored until a winner is called.

The game caller also has easy access to the computer control section by a panel 28. Behind the panel 28 can be located a keyboard or mouse for further controlling the computer system. In a preferred embodiment, the video monitor 25 can be a touch screen monitor, minimizing the need to use a keyboard or mouse.

Also in a preferred embodiment, an opening 29 to the air suction chamber is provided for easy access by the game caller or a repair person. The opening 29 can provide easy access to an air mover device such that the entire system does not have to be disassembled for maintenance or replacement.

Figure 3:
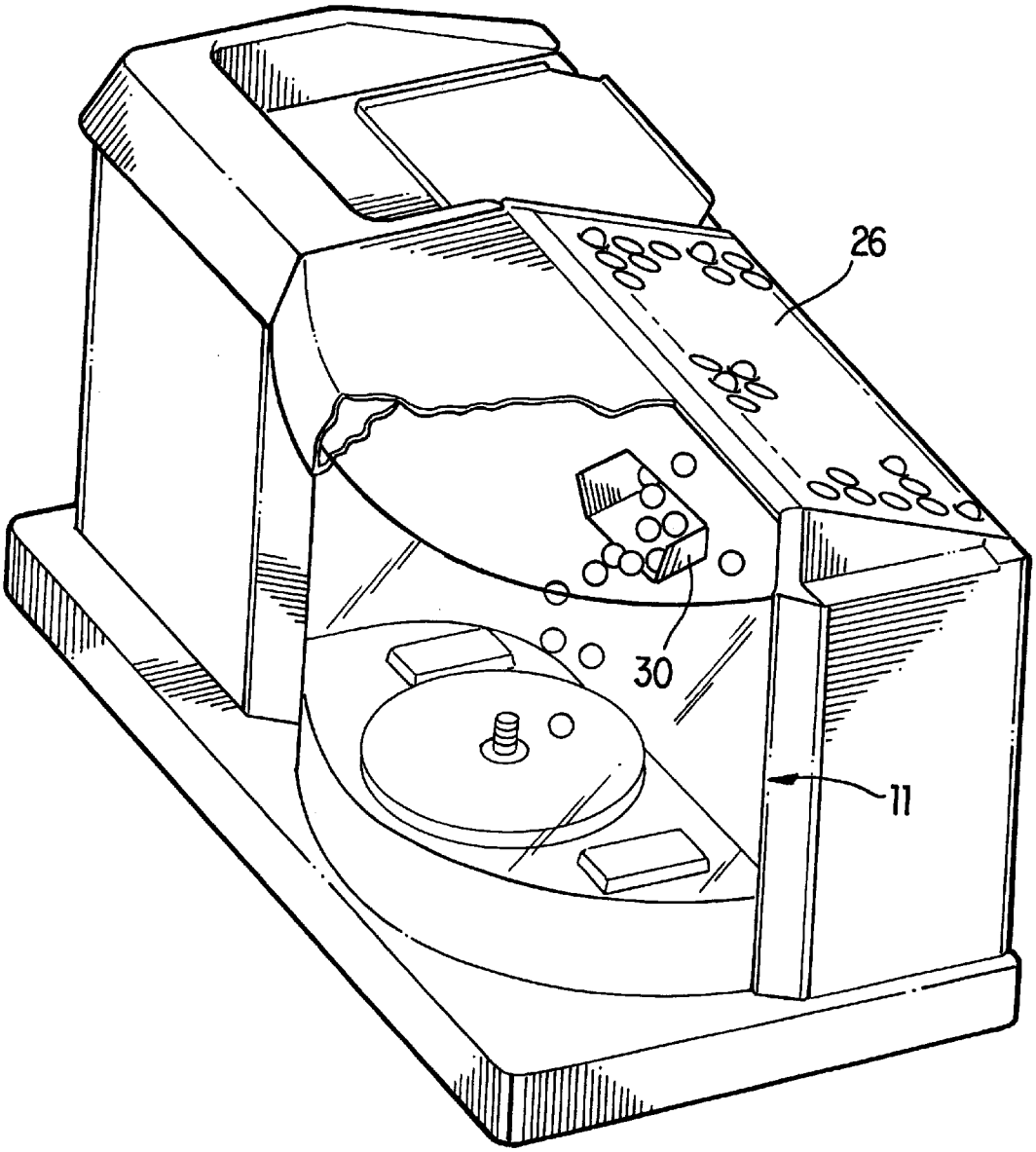
FIG. 3 is a partial section view of the random game selection device to this invention, detailing the ball return from the ball collection tray.

In another preferred embodiment, FIG. 3 shows a chute 30 for returning balls from the ball collection tray 26 to the air mix housing 11. The chute 30 is formed so as to catch all of the game balls which fall through ball collection tray 26. These general types of mechanisms are known in the art. For example, see U.S. Pat. No. 5,622,367 which describes a type of sliding plate mechanism.

Figure 4:
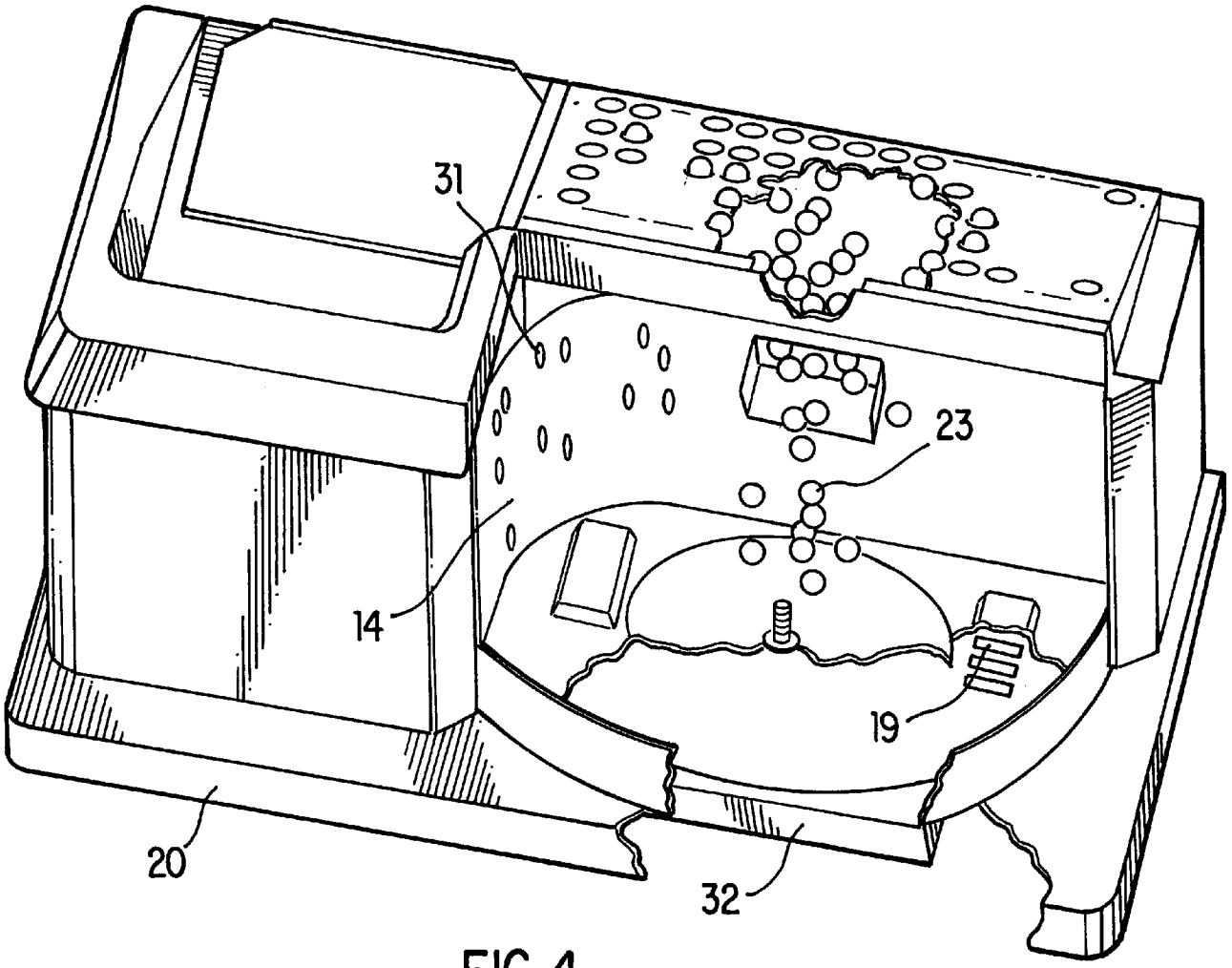
FIG. 4 is a partial section view of the random game selection device of this invention, detailing the back wall portion of the air mix housing.

A preferred embodiment of the air mix housing is shown in FIG. 4. In particular, the air mix housing includes a curved vertical back wall 14 which comprises an image reflecting surface internal to the air mix housing. The curved vertical back wall 14 is preferably asymmetrically curved such that it has a radial center offset from the radial center of the curved vertical front wall. The asymmetrical curvature provides a reflected image 31 which is somewhat distorted from the appearance of the actual game balls 23 as they bounce around inside the air mix housing. Thus, an illusion is provided to enhance the action of the bouncing game balls. This is particularly advantageous as the number of balls are reduced during play.

Recycle air vent 19 is shown in a preferred embodiment in FIG. 4 as having louvers. These louvers can be adjusted to affect the flow of air through the recycle air vent. The greater the recycle air vent is opened, the greater the amount of air that can be recycled.

Air external to the air mix housing can be brought into the device by way of an air intake control device 32. As shown in FIG. 4, the air intake control device 32 is located underneath the base 20, and can be used to limit the amount of air that is forced into the air mix housing.

Figure 5:
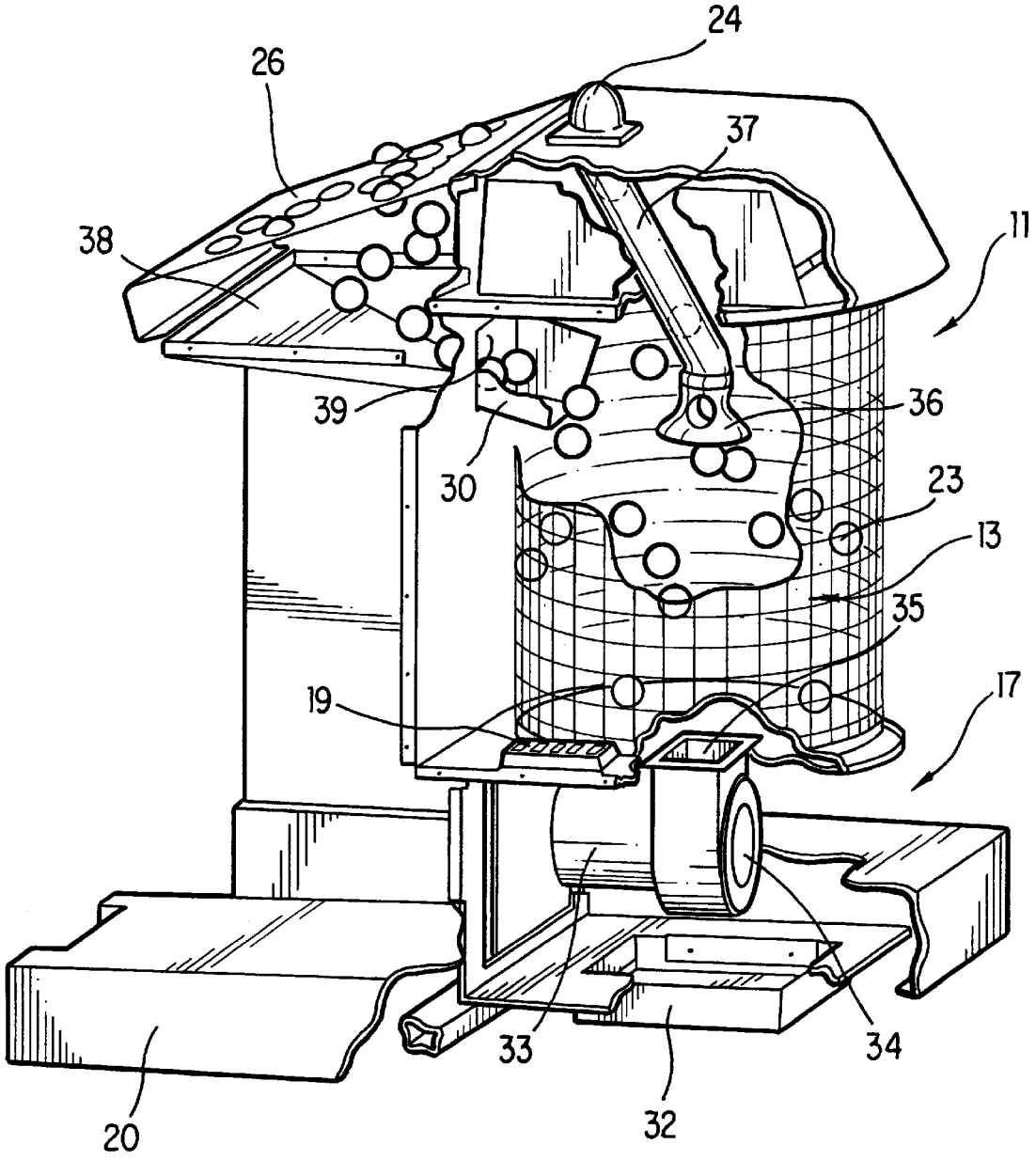
FIG. 5 is a partial section view of the random selection game device of this invention, showing details of the air suction chamber.

A detail of the air suction chamber 17 is shown in FIG. 5. According to this preferred embodiment, the air suction chamber 17 comprises an air mover or blower 33 having a suction end 34 and a discharge end 35. Air external to the random selection game device 10 is brought into the air mix housing 11 by intaking the air underneath base 20 and air intake control 32. The amount of air that passes through the air intake control 32 is controlled by the distance from the edge of the air intake control to the floor which supports base 20. In other words, the greater the gap between the air intake control 20 and the surrounding floor, the greater the amount of air that can pass into the air mix housing 11. Once air from outside the air mix housing passes through the air intake control 32, it passes into the suction end 34 of the air mover 33. A filter can be provided at the air intake control 32 in order to minimize the amount of dust or other particles which might come in to contact with air mover 33.

Air from the air mover 33 is discharged through the discharge end 35, with the air discharge end 35 being connected to the air intake section of the bottom portion of air mix housing 11. Of course, air that is recycled is taken from the air mix housing 11 and passed through recycle air vent 19 back to suction end 34 of air mover 33.

In the preferred embodiment shown in FIG. 5, the game balls 23 are displaced only within the inner vertical walled section 13 of the air mix housing 11. The inner vertical wall 16, which defines the inner vertical walled section 13, is permeable to air, but does not allow the game balls 23 to come into contact with the external vertical wall of the air mix housing 11. The result is that there is a substantial reduction in noise.

As the game balls bounce around within the air mix housing, will be randomly displaced through ball cone 36, and then passed through ball tube 37, ultimately being trapped by ball catch 24.

Once the game balls are caught in ball catch 24, the game caller identifies the ball to the game players, or an image of the ball can be captured by an attached camera. After the game ball is identified, the game caller removes the game ball from the ball catch 24 and places it in the ball collecting tray 26. Once a winner is declared, the balls can be released from the ball collecting tray 26, passing to a receiver tray 38. The balls can be held in the receiver tray 38 by a door 39, which is opened to pass the balls through chute 30, and back down into the air mix housing 11. The air mix housing preferably includes the inner vertical walled section 13, and the balls passing from chute 30 are dropped directly into the inner vertical walled section. The door 39 is preferably operated in guillotine fashion to enable the balls to easily pass to chute 30. The receiver tray 38 and the chute 30 can be intergrally formed or they may be made from separate pieces.

Figure 6:
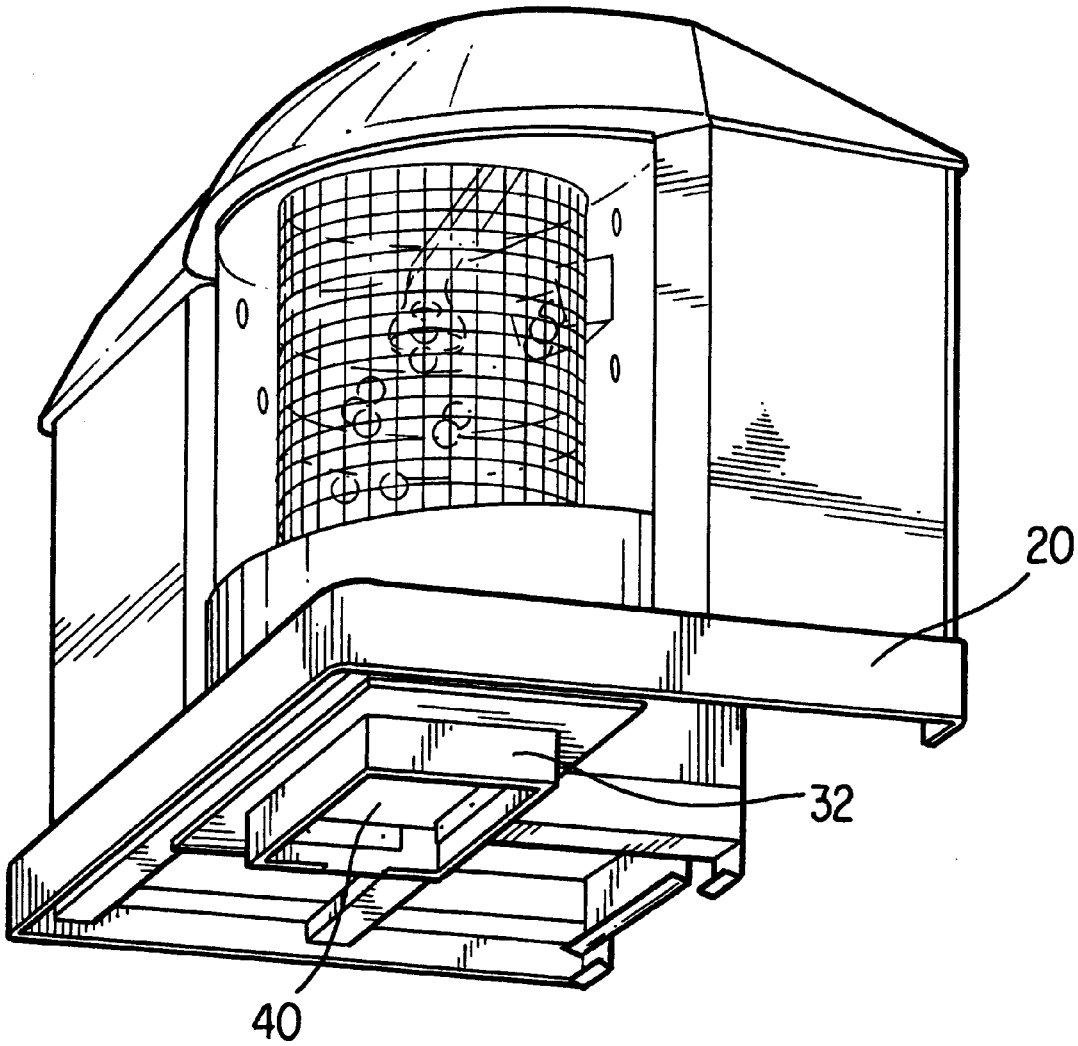
FIG. 6 is a bottom perspective view of the random selection game device, further showing the air intake control portion of the invention.

FIG. 6 shows the underside of base 20 of the random selection game device 10. In a preferred embodiment, the air intake control 32 is a rubber skirt which can be adjusted to control the amount of air which is brought into the overlying suction end of the air mover. The rubber skirt can be adjusted in a variety of ways including cutting the skirt into predetermined lengths, folding it up on itself and adjustably fastening it to the base 20 so that it can move in an up or down matter. In a preferred embodiment, an air filter 40 is located between the air intake control device and the air suction chamber opening.

Having now fully described this invention, it will be appreciated that those skilled in the art that the invention can be performed within a wide range of shapes and parameters equivalent to what is literally claimed and specifically described herein.

What is claimed is:

1. A random selection game device comprising:

a) an air mix housing comprising an outer vertical walled section and an inner vertical walled section, the inner vertical walled section being permeable to air, a top portion and a bottom portion abutting the inner and outer vertical walled sections, the bottom portion of the air mix housing having an air discharge section and an air intake section; and b) an air mover having an air discharge end and an air suction end, the air discharge end being connected to the air intake section of the of the bottom portion of the air mix housing and the air suction end being in fluid connection with the air discharge section of the bottom portion of the air mix housing.

2. The random selection game device of claim 1, further comprising an air suction chamber enclosing the air mover, with the air suction chamber having an opening for supplying air to the air suction end of the air mover.

3. The random selection game device of claim 2, further comprising an air intake control device in fluid connection with the air suction chamber opening to control the amount of air that is supplied to the air suction end of the air mover.

4. The random selection game device of claim 3, further comprising an air filter between the air intake control device and the air suction chamber opening.

5. The random selection game device of claim 1, further comprising a flexible, static discharge bar electrically grounded to the bottom portion of the air mix housing, and covering the air intake section of the bottom portion of the air mix housing.

6. The random selection game device of claim 1, wherein the outer vertical walled section comprises a curved vertical back wall connected to a curved vertical front wall, the curved vertical back wall and the curved vertical front wall each having a radial center offset from one another, the vertical back wall further comprising an image reflecting surface internal to the air mix housing.

7. A random selection game device comprising:

a) an air mix housing comprising a curved vertical back wall connected to a curved vertical front wall, the curved vertical back wall and the curved vertical front wall each having a radial center offset from one another, the vertical back wall further comprising an image reflecting surface internal to the air mix housing, and a top portion and a bottom portion abutting the curved vertical back wall and the curved vertical front wall, the bottom portion of the air mix housing having an air discharge section and an air intake section; and b) an air mover having an air discharge end and an air suction end, the air discharge end being connected to the air intake section of the of the bottom portion of the air mix housing and the air suction end being in fluid connection with the air discharge section of the bottom portion of the air mix housing.

8. The random selection device of claim 7, further comprising an inner vertical wall section permeable to air, internal to the air mix housing, and abutting the top and bottom portions.

9. The random selection game device of claim 7 or 8, further comprising an air suction chamber enclosing the air mover, with the air suction chamber having an opening for supplying air to the air suction end of the air mover.

10. The random selection game device of claim 9, further comprising an air intake control device in fluid connection with the air suction chamber opening to control the amount of air that is supplied to the air suction end of the air mover.

11. The random selection game device of claim 7, further comprising a flexible, static discharge bar electrically grounded to the bottom portion of the air mix housing, and covering the air intake section of the bottom portion of the air mix housing.

12. A random selection game device comprising:

a) an air mix housing comprising vertical walls, and a top portion and a bottom portion abutting the vertical walls, the bottom portion of the air mix housing having an air discharge section and an air intake section;

b) an air mover having an air discharge end and an air suction end, the air discharge end being connected to the air intake section of the of the bottom portion of the air mix housing and the air suction end being in fluid connection with the air discharge section of the bottom portion of the air mix housing; and c) a flexible, static discharge bar electrically grounded to the bottom portion of the air mix housing, and covering the air intake section of the bottom portion of the air mix housing.

13. The random selection device of claim 12, further comprising an inner vertical walled section permeable to air, internal to the air mix housing, and abutting the top and bottom portions.

14. The random selection game device of claim 12 or 13, further comprising an air suction chamber enclosing the air mover, with the air suction chamber having an opening for supplying air to the air suction end of the air mover.

15. The random selection game device of claim 12, further comprising an air intake control device in fluid connection with the air suction chamber opening to control the amount of air that is supplied to the air suction end of the air mover.

16. The random selection game device of claim 12, wherein the vertical walls comprise a curved vertical back wall section connected to a curved vertical front wall section, the curved vertical back wall section and the curved vertical front wall section each having a radial center offset from one another, and the vertical back wall section having an image reflecting surface internal to the air mix housing.

* * * * *